US009113679B2

(12) United States Patent
Lee et al.

(10) Patent No.: US 9,113,679 B2
(45) Date of Patent: Aug. 25, 2015

(54) BUCKLE AND METHOD FOR PREVENTING THE BUCKLE FROM BEING RELEASED BY AN IMPACT

(75) Inventors: Kyung Sang Lee, Anyang-si (KR); Taek Lim Song, Gunpo-si (KR); Young Hyun Kim, Hwaseong-si (KR)

(73) Assignee: Wooshin Safety Systems Co., Ltd., Hwaseong-si, Gyeonggi-do (KR)

( * ) Notice: Subject to any disclaimer, the term of this patent is extended or adjusted under 35 U.S.C. 154(b) by 0 days.

(21) Appl. No.: 13/497,787

(22) PCT Filed: Sep. 20, 2010

(86) PCT No.: PCT/KR2010/006460

§ 371 (c)(1), (2), (4) Date: Mar. 22, 2012

(87) PCT Pub. No.: WO2011/037387

PCT Pub. Date: Mar. 31, 2011

(65) Prior Publication Data

US 2012/0174353 A1 Jul. 12, 2012

(30) Foreign Application Priority Data

Sep. 22, 2009 (KR) ..... 10-2009-0089731

(51) Int. Cl.
*A44B 11/26* (2006.01)
*A44B 11/25* (2006.01)

(52) U.S. Cl.
CPC ..... *A44B 11/2523* (2013.01); *A44B 11/2573* (2013.01); *Y10T 24/45241* (2015.01)

(58) Field of Classification Search
USPC ..... 24/641
See application file for complete search history.

(56) References Cited

U.S. PATENT DOCUMENTS 4,451,958 A * 6/1984 Robben et al. ..... 24/636
4,454,634 A * 6/1984 Haglund et al. ..... 24/636

(Continued)

FOREIGN PATENT DOCUMENTS

JP 03-082401 A 4/1991
KR 10-1991-0006563 B1 8/1991

(Continued)

OTHER PUBLICATIONS

PCT International Search Report for PCT Counterpart Application No. PCT/KR2010/006460 containing Communication relating to the Results of the International Search Report, 3 pgs., (Jun. 28, 2011).

(Continued)

*Primary Examiner* — Robert J Sandy
*Assistant Examiner* — David Upchurch
(74) *Attorney, Agent, or Firm* — Blakely, Sokoloff, Taylor & Zafman LLP

(57) ABSTRACT

A buckle and a method for preventing the buckle from being released by an impact are described. The buckle may include a frame, a tongue inserted into the frame and locked with the frame, an ejector provided in the frame to push the tongue outward from the frame, a holder that prevents the ejector from pushing the tongue outward from the frame by being displaced forward the ejector, thereby maintaining locking of the tongue, and a withdrawal prevention unit that prevents the holder from moving back beyond withdrawing and being displaced backward the ejector when an impact is applied from an outside of the frame, thereby preventing the locking of the tongue from being released by the impact.

5 Claims, 2 Drawing Sheets

(56) References Cited

U.S. PATENT DOCUMENTS

| | | | | | |
|---|---|---|---|---|---|
| 4,562,625 | A | * | 1/1986 | Doty et al. | 24/690 |
| 4,624,034 | A | * | 11/1986 | Ishiguro et al. | 24/641 |
| 4,797,984 | A | * | 1/1989 | Seto et al. | 24/641 |
| 4,802,266 | A | * | 2/1989 | Doty et al. | 24/637 |
| 5,005,267 | A | * | 4/1991 | Sugimoto | 24/637 |
| 5,341,546 | A | * | 8/1994 | Burke | 24/641 |
| 6,385,823 | B1 | * | 5/2002 | Yamaguchi et al. | 24/641 |
| 7,543,363 | B2 | * | 6/2009 | Webber et al. | 24/641 |
| 2004/0163224 | A1 | * | 8/2004 | Sato et al. | 24/641 |

FOREIGN PATENT DOCUMENTS

| | | | |
|---|---|---|---|
| KR | 10-2001-0030680 | A | 4/2001 |
| KR | 10-2002-0024324 | A | 3/2002 |
| WO | WO 2009/090002 | A1 | 7/2009 |

OTHER PUBLICATIONS

Office Action for Korean Patent Application No. 10-2009-0089731, 4 pgs., (May 18, 2011).

Notice of Allowance for Korean Patent Application No. 10-2009-0089731, 3 pgs., (Jan. 30, 2012).

* cited by examiner

BUCKLE AND METHOD FOR PREVENTING THE BUCKLE FROM BEING RELEASED BY AN IMPACT

CROSS-REFERENCE TO RELATED APPLICATIONS

This patent application is a U.S. National Phase Application under 35 U.S.C. §371 of International Application No. PCT/KR2010/006460, filed Sep. 20, 2010, entitled BUCKLE AND METHOD FOR PREVENTING THE BUCKLE FROM BEING RELEASED BY AN IMPACT, which claims priority to Korean Patent Application No. 10-2009-0089731, filed Sep. 22, 2009.

TECHNICAL FIELD

The present invention relates to a buckle and a method for preventing the buckle from being released by an impact, and more particularly to a method for preventing a buckle from being released by a vehicle collision impact and a buckle using the same.

BACKGROUND ART

In general, a buckle has a configuration in which two facing members are coupled to each other and fixed, and has been used in various technology fields. Among them, in the case of a vehicle, a buckle is mainly used for a seat belt provided in a seat. In the case of a buckle used for a seat belt, it is necessary to consider unexpected release of the buckle caused by a vehicle collision impact as well as the convenience for the driver.

That is, in a normal use, easy locking and release of the buckle is important so that a driver can easily lock or release the seat belt. However, in the case of a vehicle collision, it is necessary to prevent the buckle from being released by an unexpected external impact.

DISCLOSURE OF INVENTION

Technical Problem

Therefore, it is an object of the present invention to provide a buckle, which is prevented from being released by an unexpected external impact, and a method for preventing the buckle from being released by an impact.

It is another object of the present invention to provide a buckle, which is prevented from being released by a vehicle collision impact when the buckle is used for a seat belt for a vehicle seat, and a method for preventing the buckle from being released by the impact.

Solution to Problem

In order to achieve the above-mentioned objects, there is provided a buckle including a frame, a tongue inserted into the frame and locked with the frame, an ejector provided in the frame to push the tongue outward from the frame, a holder that prevents the ejector from pushing the tongue outward from the frame by being displaced forward the ejector, thereby maintaining locking of the tongue, and a withdrawal prevention unit that prevents the holder from moving back beyond withdrawing and being displaced backward the ejector when an impact is applied from an outside of the frame, thereby preventing the locking of the tongue from being released by the impact.

Furthermore, in the buckle according to an embodiment of the present invention, it is characterized in that the withdrawal prevention unit may include a body pivotally coupled to the frame and pivoting toward the holder by means of a moment generated when a pivot point of the body and a center of gravity of the body are spaced from each other, and an elastic member provided between the body and the holder to apply an expansion force to the body and the holder, thereby preventing the body from interrupting withdrawal of the holder when an impact is not applied from an outside of the frame.

Furthermore, in the buckle according to the embodiment of the present invention, it is characterized in that the moment required when the body pivots is larger than the expansion energy generated by the expansion force of the elastic member when an impact is applied from an outside of the frame, and the body pivots toward the holder to prevent the withdrawal of the holder.

Furthermore, in the buckle according to the embodiment of the present invention, it is characterized in that the weight of a first end of the body facing the holder is different from the weight of a second end disposed opposite to the first end about the pivot point of the body such that the pivot point of the body and the center of gravity of the body are spaced from each other.

In addition, in the buckle according to the embodiment of the present invention, it is characterized in that the body has a substantially reverse L shape, the pivot point of the body is located at a spot at which a curved structure is formed, a first end of the body is disposed to face the holder, and a second end is provided with a balance weight such that the pivot point and the center of gravity of the body are spaced from each other and is disposed opposite to the first end about the pivot point with the first end facing the second end.

Moreover, in the buckle according to the embodiment of the present invention, it is characterized in that the elastic member is formed of a torsion spring, a side of the torsion spring is mounted on the body, and an opposite side of the torsion spring is supported in the holder.

According to another aspect of the present invention, there is provided a method for preventing a buckle from being released by an impact, the buckle including a tongue inserted into a frame and locked with the frame, an ejector provided in the frame to push the tongue outward from the frame, a holder that prevents the ejector from pushing the tongue outward from the frame by being displaced forward the ejector, thereby maintaining locking of the tongue, and a withdrawal prevention unit comprising a body and an elastic member, wherein the body pivotally coupled to the frame and pivoting toward the holder by means of a moment generated when a pivot point of the body and a center of gravity of the body are spaced from each other, wherein the elastic member provided between the body and the holder to apply expansion force to the body and the holder, thereby preventing the body from interrupting withdrawal of the holder when an impact is not applied from an outside of the frame, wherein a moment required when the body pivots is larger than expansion energy generated by expansion force of the elastic member by an impact applied from an outside of the frame, so that the body of the withdrawal prevention unit pivots toward the holder, and wherein the body of the withdrawal prevention unit pivots toward the holder to prevent the holder from withdrawing and being displaced backward the ejector, thereby preventing the locking of the tongue from being released.

Furthermore, in the method according to the embodiment of the present invention, it is characterized in that, in the body of the withdrawal prevention unit, the weight of a first end of the body facing the holder is different from the weight of a second end disposed opposite to the first end about a pivot point of the body such that the pivot point and the center of gravity are spaced from each other.

Furthermore, in the method according to the embodiment of the present invention, it is characterized in that the body of the withdrawal prevention unit has a substantially reverse L shape, the pivot point of the body is located at a spot at which a curved structure is formed, a first end of the body is disposed to face the holder, and a second end is provided with a balance weight such that the pivot point and the center of gravity of the body are spaced from each other and is disposed opposite to the first end about the pivot point with the first end facing the second end.

Advantageous Effects of Invention

According to the buckle having the above-mentioned configuration and the method for preventing the buckle from being released by an impact in accordance with the present invention, the buckle can be prevented from being released by an unexpected impact.

Furthermore, when the buckle according to the present invention is used for a seat belt for a vehicle seat, the buckle can be prevented from being released by a vehicle collision impact, so that the safety of a user can be further ensured.

MODE FOR THE INVENTION

Figure 1:
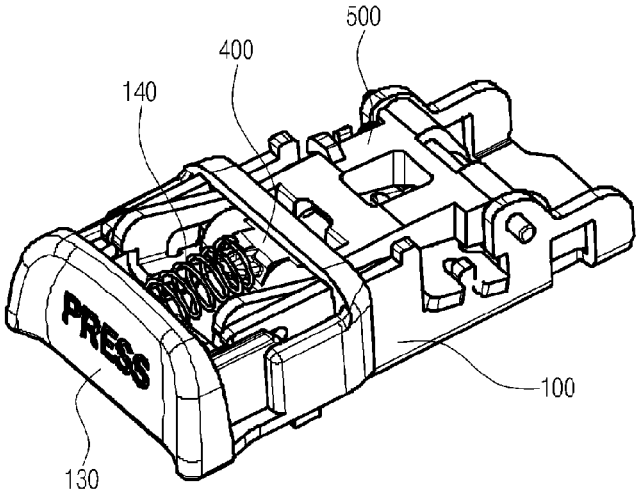
FIG. 1 is an assembled perspective view illustrating the interior of a buckle according to an embodiment of the present invention.

Hereinafter, a buckle and a method for preventing a buckle from being released by an impact according to an embodiment of the present invention will be described in detail with reference to the accompanying drawings.

In the drawings, the sizes, shapes and the like of elements may be exaggerated for clarity and convenience. Furthermore, terms specifically defined in consideration of the configuration and operation of the present invention may vary depending on a user's or operator's intention or customs. Definition for these terms should be determined throughout the contents of the specification.

Figure 2:
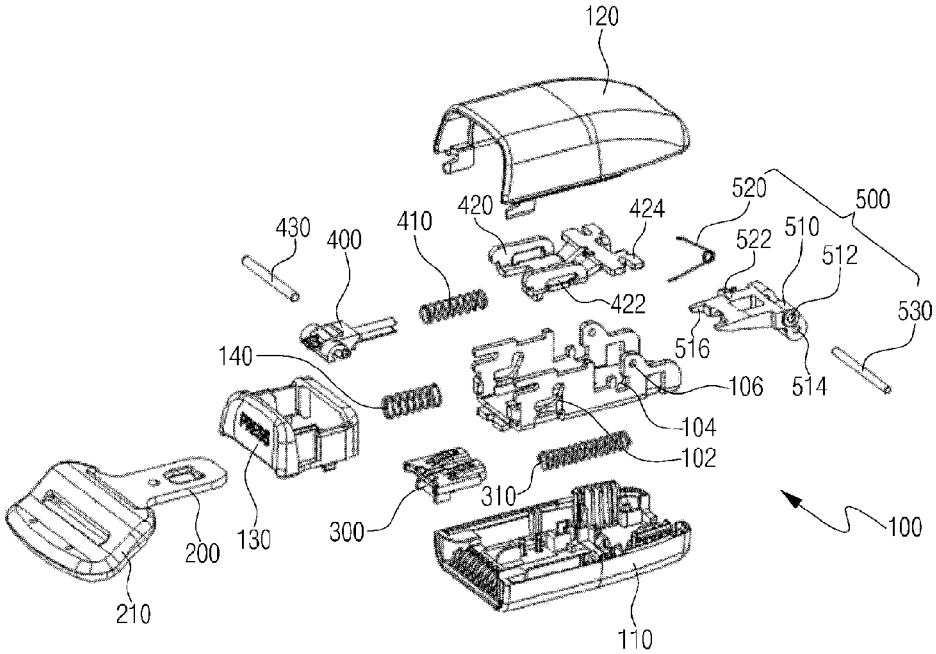
FIG. 2 is an exploded perspective view illustrating a buckle according to an embodiment of the present invention.
Figure 3:
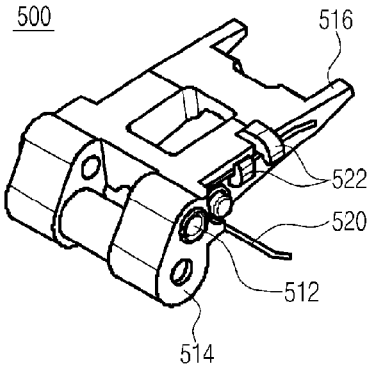
FIG. 3 is a partial enlarged assembled perspective view illustrating a withdrawal prevention unit of a buckle according to an embodiment of the present invention.

FIG. 1 is an assembled perspective view illustrating the interior of a buckle according to an embodiment of the present invention, FIG. 2 is an exploded perspective view illustrating the buckle according to the embodiment of the present invention, and FIG. 3 is a partial enlarged assembled perspective view illustrating a withdrawal prevention unit of the buckle according to the embodiment of the present invention. As illustrated in FIGS. 1 to 3, the buckle according to the embodiment of the present invention includes a frame 100, a tongue 200, an ejector 300, a holder 400 and a withdrawal prevention unit 500.

The frame 100 forms the whole external appearance of the buckle according to the embodiment of the present invention together with the tongue 200, and has the ejector 300, the holder 400, the withdrawal prevention unit 500 and the like therein together with various members such that the tongue 200 can be inserted into the frame 100 and locked with the frame 100.

That is, the frame 100 may have a hexahedral shape with a partially opened surface similar to the shape of a general buckle. The frame 100 may be formed at the lower end thereof with a through hole into which the tongue 200 can be inserted. The frame 100 may be formed at the side thereof with the grooves or holes 102, 104 and 106 through which the ejector 300, the holder 400, the withdrawal prevention unit 500 and the like can be inserted into the grooves or holes 102, 104 and 106 such that they are engaged with one another. The grooves or the holes will be described in detail later.

Furthermore, the frame 100 having such a configuration may be made of a metal material with high durability such that the frame 100 is not easily abraded and is not easily broken by an external impact when the ejector 300, the holder 400, the withdrawal prevention unit 500 and the like are engaged with one another.

In addition, in order to prevent interruption of the operations of the elements in the frame 100 or enhance the durability of the elements, covers may be provided at the outer side of the frame 100 to cover the frame 100. The covers may include a lower cover 110 and an upper cover 120. The lower cover 110 may be provided at the inner side thereof with members that fix protrusions or pins 424, 430 and 530, which are inserted into the grooves or the holes 102, 104 and 106 of the frame 100, such that the protrusions or pins 424, 430 and 530 are not separated from the grooves or the holes 102, 104 and 106.

Meanwhile, a button 130 engaged with the ejector 300 and the holder 400 is provided in front of the frame 100. If a user presses the button 130, the tongue 200 is easily released. That is, if a user presses the button 130 in order to release the buckle according to the embodiment of the present invention, the holder 400 coupled to the button 130 and a button spring 140 moves back and the ejector 300 pushes the tongue 200 outward from the frame 100, so that the tongue 200 is released. Consequently, the buckle according to the embodiment of the present invention is released. The button spring 140 returns to the original position after the button 130 is pressed, so that the button spring 140 performs the same operation after the tongue 200 is locked again.

The tongue 200 is inserted into the frame 100 as described above, and is locked with members, which are provided in the frame 100, such as the holder 400 and a latch 420 engaged with the holder 400. That is, if the tongue 200 is inserted into the frame 100, the ejector 300 moves back and simultaneously the holder advances by insertion force of the tongue 200, and the latch 420 coupled to the holder 400 moves toward the tongue 200 inserted into the lower end of the frame 100. At this time, a latch portion provided at the latch 420 is locked with a groove or a hole formed in the tongue 200.

Meanwhile, a connection member 210 may be provided at a side of the tongue 200, which is opposite to the insertion side of the tongue 200, such that a band of a belt provided at the buckle according to the embodiment of the present invention can be connected. The connection member 210 may be comprised of a hole in consideration of the width and thickness of the band.

The ejector 300 is provided in the frame 100 to push the tongue 200 outward from the frame 100 such that the tongue 200 locked with the frame 100 can be released.

One end of the ejector 300 is a free end and is directed to the tongue 200 to be inserted, and the other end thereof is a fixed end and may be coupled to the frame 100 by an ejector spring 310 that pushes the tongue 200 in the direction opposite to the insertion direction of the tongue 200. Furthermore, the ejector 300 may move forward or backward in the through hole in the frame 100, into which the tongue 200 is inserted, by elastic force of the ejector spring 310.

The ejector 300 with such a structure operates as follows. If a user inserts the tongue 200 into the frame 100, the ejector 300 moves to the rear side of the frame 100 by the user's force. Simultaneously to this, the ejector spring 310 provided at the other end of the ejector 300 is compressed, and the holder 400 advances beyond the ejector 300 as described above. As the holder 400 advances, the ejector 300 does not push the tongue 200 outward from the frame 100. This is because restoring force of a latch spring 410 provided at the holder 400, which will be described later, is larger than restoring force of the ejector spring 310. However, if the user presses the button 130 in order to release the tongue 200, the holder 400 engaged with the button 130 moves back. At this time, the restoring force of the latch spring 410 is smaller than the restoring force of the ejector spring 310 by the user's force, and the ejector 300 pushes the tongue 200 outward from the frame 100 by the restoring force of the ejector spring 310.

As described above, the holder 400 is disposed at a front side of the frame 100 beyond the ejector 300, particularly, at a front side of the through hole of the frame 100, thereby preventing the tongue 200 from being pushed outward from the frame 100 by the ejector 300. The holder 400 performing such an operation may have other configurations if the inserted tongue 200 is prevented from being pushed by the ejector 300. In this regard, the buckle according to the embodiment of the present invention may have the following configuration.

The holder 400 has one end coupled to the button 130 through the button spring 140, and the other one end coupled to the latch 420 through the latch spring 410. Furthermore, the holder 400 includes a holder pin 430 passing through the substantially L shaped holes 102 formed in the lateral side of the frame 100, and latch holes 422 formed in the latch 420.

The latch 420 coupled to the other end of the holder 400 is locked with the tongue 200 together with the holder 400, and is provided at one end thereof with the latch spring 410 and at the other end thereof with the protrusions 424. The protrusions 424 are pivotally inserted into the grooves 104 of the frame 100, and may have various shapes. Meanwhile, the latch hole 422 is formed in a straight type in one end surface of the latch 420 along the longitudinal direction of the latch 420. The shape of the latch hole 422 is different from that of the substantially L shaped hole 102 through which the holder pin 430 passes. This is for allowing the holder 400 and the latch 420 to be engaged with each other in an opposite direction as described later.

The holder 400 having such a configuration and the latch 420 coupled to the holder 400 operate as follows.

If a user inserts the tongue 200 into the frame 100 in order to lock the buckle according to the embodiment of the present invention, the ejector 300 moves back and simultaneously the holder pin 430 provided at the holder 400 moves along the substantially L shaped holes 102 by the restoring force of the latch spring 410. As the holder pin 430 moves as described above, the holder 400 provided with the holder pin 430 also moves along the substantially L shaped holes 102 and advances beyond the ejector 300. Since the holder pin 430 passes through the latch holes 422 as well as the substantially L shaped holes 102, the latch 420 formed with the latch holes 422 moves when the holder 400 advances.

However, the holder pin 430 passes through the latch holes 422 at a fixed position and movably passes through the latch hole 422 according to the shape of the latch hole 422, the latch 420 operates simultaneously when the holder 400 operates but the operation direction of the latch 420 is different from that of the holder 400. That is, the holder 400 moves to the front lower side of the frame 100 along the substantially L shaped holes 102, and the latch 420 only moves to the lower side of the frame 100 other than the front side of the frame 100. As described above, if the latch 420 pivots downward, the latch portion provided at the latch 420 is locked with the groove or hole formed in the tongue 200, resulting in the locking of the tongue 200.

Meanwhile, if a user presses the button 130 in order to release the buckle according to the embodiment of the present invention, the holder 400 coupled to the button 130 moves to the rear upper side of the frame 100. Since the holder pin 430 provided at the holder 400 moves along the substantially L shaped holes 102 of the frame 100 as well as the latch holes 422 formed in the latch 420, the latch 420 also moves together with the holder 400. However, since the shape of the substantially L shaped hole 102 is different from that of the latch hole 422, the holder 400 moves to the rear upper side of the frame 100 and the latch 420 only moves upward. As the latch 420 moves upward, the latch portion provided at the latch 420 is released from the groove or hole formed in the tongue 200, so that the locking of the tongue 200 is released. In addition, as the holder 400 moves back, the ejector 300 pushes the tongue 200 outward from the frame 100 by the restoring force of the ejector spring 310.

The withdrawal prevention unit 500 operates when an impact is applied from the outside of the frame 100, differently from the general operation of the buckle according to the embodiment of the present invention as described above. That is, the withdrawal prevention unit 500 does not exert influence on the operations of other elements when an impact is not applied from the outside of the frame 100. However, when an impact is applied from the outside of the frame 100, the withdrawal prevention unit 500 exerts influence on the operations of other elements.

The withdrawal prevention unit 500 may include a body 510 and an elastic member 520.

The body 510 is pivotally coupled to the frame 100 and the pivot point is spaced from the center of gravity. The weight of one end 516 of the body 510 facing the holder 400 is set to be different from the weight of the other end 514 disposed at an opposite side of the one end 516 about the pivot point, so that the pivot point and the center of gravity of the body 510 can be spaced from each other.

According to the embodiment of the body 510 having such a configuration, the body 510 may have a substantially reverse L shape. As the body 510 has a substantially reverse L shape, the pivot point of the body 510 is located at a spot at which a curved structure is formed, and the one end 516 and the other end 514 of the body 510 are bent at a predetermined angle, so that the one end 516 is disposed opposite to the other end 514 about the pivot point. Since a pivot pin 530 is inserted into the pin holes 106 formed in the frame 100 after passing through the body 510 at the pivot point, the body 510 is pivotally coupled to the frame 100. Furthermore, the one end 516 is disposed to face the holder 400, and the other end 514 is provided with a balance weight 512 such that the pivot point and the center of gravity of the body 510 are spaced from each other and is disposed opposite to the one end 516.

As described above, the positional difference between the pivot point and the center of gravity of the body 510 causes a moment in the body 510, and the body 510 pivots toward the holder 400 by means of the moment.

However, if the end 516 of the body 510 always pivots toward the holder 400 by means of the moment, the buckle is not released by an impact. That is, it may be problematic when the buckle according to the embodiment of the present invention is released by the user's intention. For example, if the end 516 of the body 510 pivots toward the holder 400 and further makes contact with the holder 400, since the holder 400 does not normally move back by the body 510, the locking of the tongue 200 may not be released.

In order to solve such a problem, the elastic member 520 is required in order to prevent the body 510 from interrupting the withdrawal of the holder 400 when an impact is not applied from the outside of the frame 100. That is, the elastic member 520 is provided between the body 510 and the holder 400 to apply expansion force to the body 510 and the holder 400. Such an elastic member 520 may be formed of a torsion spring which enables relatively simple mechanical operation and can be easily acquired. One side of the torsion spring is fitted into a mounting groove 522 formed in the body 510 and the other side thereof is supported by the holder 400.

The withdrawal prevention unit 500 having such a configuration prevents the holder 400 from moving back beyond the ejector 300 when an impact is applied from the outside of the frame 100, thereby preventing the locking of the tongue 200 from being released by the impact.

Hereinafter, the operation of the withdrawal prevention unit 500 will be described in more detail with reference to FIGS. 4 to 7.

Figure 4:
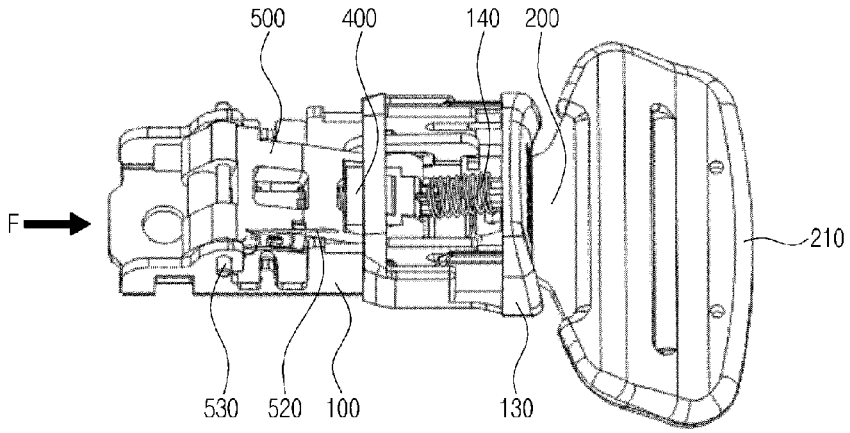
FIG. 4 is a diagram showing the operation state when a withdrawal prevention unit operates in a buckle according to an embodiment of the present invention.
Figure 5:
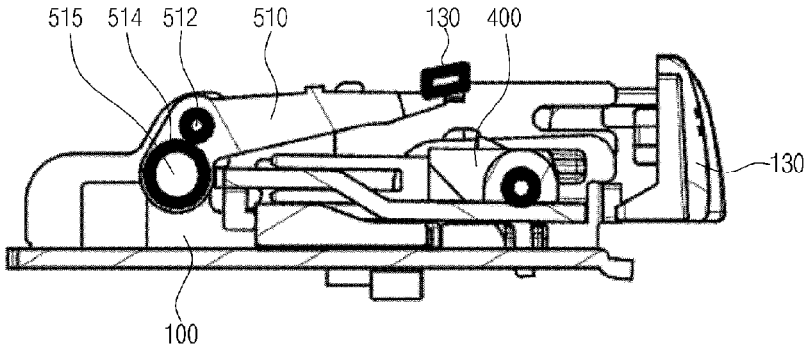
FIG. 5 is a sectional view taken along line A-A' and shows the state before a withdrawal prevention unit operates in a buckle according to an embodiment of the present invention.
Figure 6:
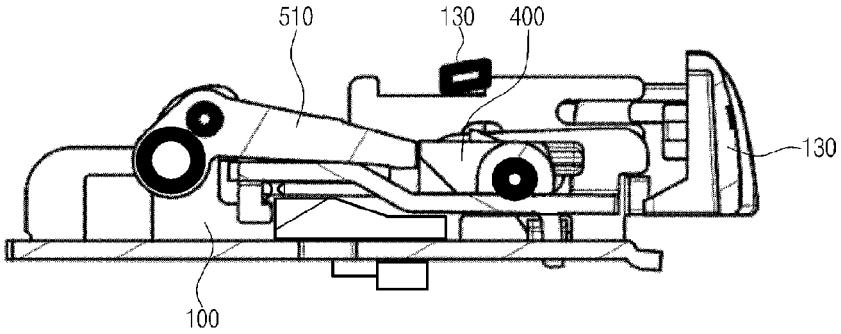
FIG. 6 is a sectional view taken along line A-A' and shows the operation state of a withdrawal prevention unit in a buckle according to an embodiment of the present invention.
Figure 7:
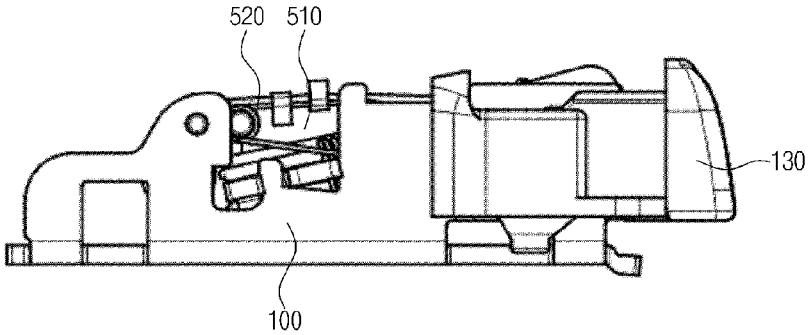
FIG. 7 is a side view taken showing the state after a withdrawal prevention unit operates in a buckle according to an embodiment of the present invention.

FIG. 4 is a diagram showing the operation state when the withdrawal prevention unit operates in the buckle according to the embodiment of the present invention, FIG. 5 is a sectional view taken along line A-A' and shows the state before the withdrawal prevention unit operates in the buckle according to the embodiment of the present invention, FIG. 6 is a sectional view taken along line A-A' and shows the operation state of the withdrawal prevention unit in the buckle according to the embodiment of the present invention, and FIG. 7 is a side view taken showing the state after the withdrawal prevention unit operates in the buckle according to the embodiment of the present invention.

Referring to FIG. 5, when an impact is not applied from the outside of the frame 100, expansion energy generated by the expansion force of the elastic member 520 of the withdrawal prevention unit 500 is larger than the moment required when the body 510 of the withdrawal prevention unit 500 pivots. Thus, since the one end 516 of the body 510 is not disposed to face the holder 400, the one end 516 does not interrupt the above-mentioned movement of the holder 400. That is, when an impact is not applied from the outside of the frame 100, the tongue 200 may be locked with the frame 100 or released from the frame 100 according to the user's intention.

However, when an impact is applied from the outside of the frame 100, particularly, if impact force F is applied to the frame 100 as shown in FIG. 4, the expansion energy generated by the expansion force of the elastic member 520 is smaller than the moment required when the body 510 pivots. Thus, as shown in FIG. 6, since the one end 516 of the body 510 is disposed to face the holder 400, the one end 516 interrupts the above-mentioned movement of the holder 400. That is, when an impact is applied from the outside of the frame 100, the withdrawal prevention unit 500 prevents the withdrawal of the holder 400 regardless of the user's intention, so that the holder 400 continuously maintains the state where the holder 400 has advanced beyond the ejector 300. As described above, when the holder 400 has advanced beyond the ejector 300, the locking of the tongue 200 is maintained as described above because the ejector 300 does not the tongue 200 outward from the frame 100.

Meanwhile, after the temporal impact, the expansion energy generated by the expansion force of the elastic member 520 is larger than the moment required when the body 510 pivots as shown in FIG. 7. Consequently, the withdrawal prevention unit 500 performs the same operation similarly to the case where an impact is not applied from the outside of the frame 100.

The foregoing embodiments of the invention have been presented for purposes of illustration and description only. They are not intended to be exhaustive or to limit the invention to the forms disclosed. Accordingly, the scope of the invention is defined by the appended claims, not the preceding disclosure. One skilled in the relevant art will recognize that many other equivalents or alternatives in the scope which does not divagate from the present invention are possible.

What is claimed is:

1. A buckle comprising:

a frame;

a tongue inserted into the frame and locked with the frame;

an ejector provided in the frame to push the tongue outward from the frame;

a holder that moves along substantially L shaped holes of the frame and prevents the ejector from pushing the tongue outward from the frame by being displaced forward the ejector when the holder is in a front lower location of the L shaped holes, the holder coupled with a latch that engages the tongue thereby maintaining locking of the tongue when inserted into the frame; and a withdrawal prevention unit that prevents the holder from withdrawing to a back upper location of the L shaped holes and being displaced backward the ejector when an impact is applied from an outside of the frame by blocking movement of the holder in the L shaped holes, thereby preventing the movement of the holder from front lower location of the L shaped holes and preventing the locking of the tongue from being released by the impact, wherein the withdrawal prevention unit comprises:

a body having a substantially reverse L shape, a pivot point of the body is located at a spot at which a curved structure is formed, a first end of the body is disposed to face the holder, and a second end is provided with a balance weight such that the pivot point and a center of gravity of the body are spaced from each other and is disposed opposite to the first end about the pivot point with the first end facing the second end to pivot toward the holder by a moment generated by a positional difference between the pivot point and the center of gravity of the body; and an elastic member provided between the body and the holder to apply an expansion force to the body and the holder, wherein the expansion force is greater than the moment generated by the positional difference between the pivot point and the center of gravity of the body thereby preventing the body from pivoting about the pivot point and interrupting withdrawal of the holder by preventing a blocking of movement of the holder to an upper back location within the L shaped holes, and wherein the moment required when the body pivots is larger than the expansion energy generated by the expansion force of the elastic member when an impact force is applied perpendicular to the body from an outside of the frame, and the body pivots about the pivot point toward the holder preventing the withdrawal of the holder by blocking movement of the holder to an upper back location of the L shaped holes and preventing disengaging the latch from the tongue.

2. The buckle as claimed in claim 1, wherein the moment required when the body pivots is larger than the expansion energy generated by the expansion force of the elastic member when an impact is applied from an outside of the frame, and the body pivots toward the holder to prevent the withdrawal of the holder.

3. The buckle as claimed in claim 1, wherein a weight of a first end of the body facing the holder is different from the weight of a second end disposed opposite to the first end about the pivot point of the body such that the pivot point of the body and the center of gravity of the body are spaced from each other.

4. The buckle as claimed in claim 1, wherein the elastic member is formed of a torsion spring, a side of the torsion spring is mounted on the body, and an opposite side of the torsion spring is supported in the holder.

5. A method for preventing a buckle from being released by an impact, the buckle comprising a tongue inserted into a frame and locked with the frame, an ejector provided in the frame to push the tongue outward from the frame, a holder that moves along substantially L shaped holes of the frame and prevents the ejector from pushing the tongue outward from the frame by being displaced forward the ejector when the holder is in a front lower location of the L shaped holes, the holder coupled with a latch that engages the tongue thereby maintaining locking of the tongue when inserted into the frame, and a withdrawal prevention unit comprising a body and an elastic member, wherein the body of the withdrawal prevention unit has a substantially reverse L shape, a pivot point of the body is located at a spot at which a curved structure is formed, a first end of the body is disposed to face the holder, and a second end is provided with a balance weight such that the pivot point and the center of gravity of the body are spaced from each other and is disposed opposite to the first end about the pivot point with the first end facing the second end to pivot toward the holder by a moment generated by a positional difference between the pivot point and the center of gravity of the body, wherein the withdrawal prevention unit prevents the holder from withdrawing to a back upper location of the L shaped holes when an impact is applied from an outside of the frame by blocking movement of the holder in the L shaped holes, wherein the elastic member provided between the body and the holder to apply expansion force to the body and the holder, wherein the expansion force is greater than the moment generated by the positional difference between the pivot point and the center of gravity of the body thereby preventing the body from pivoting about the pivot point and interrupting withdrawal of the holder by blocking movement of the holder to an upper back location within the L shaped holes, wherein a moment required when the body pivots is larger than expansion energy generated by expansion force of the elastic member by an impact force applied to the body from an outside of the frame, and that the body of the withdrawal prevention unit pivots toward the holder, and wherein the body of the withdrawal prevention unit pivots about the pivot point toward the holder blocking movement of the holder in the L shaped holes and preventing movement of the holder from the front lower location of the L shaped holes to prevent the holder from withdrawing and being displaced backward the ejector to the back upper location of the L shaped holes, thereby preventing disengaging the latch from the tongue.

* * * * *